United States Patent [19]

Kimble

[11] Patent Number: 4,620,502

[45] Date of Patent: Nov. 4, 1986

[54] HAND SANITIZER

[76] Inventor: Erma N. Kimble, 101 Intervale St., Apt. #2, Boston, Mass. 02121

[21] Appl. No.: 824,512

[22] Filed: Jan. 31, 1986

[51] Int. Cl.[4] ..... B05C 3/132

[52] U.S. Cl. ..... 118/419; 118/43; 118/423; 118/429

[58] Field of Search ..... 118/43, 419, 423, 429; 68/13 R; 134/127

[56] References Cited

U.S. PATENT DOCUMENTS

| | | | |
|---|---|---|---|
| 3,368,522 | 2/1968 | Cordis | 118/423 X |
| 3,592,161 | 7/1971 | Hoffman | 118/419 X |
| 3,775,801 | 12/1973 | Walker | 118/43 X |
| 3,913,522 | 10/1975 | Light | 118/43 X |

*Primary Examiner*—John P. McIntosh
*Attorney, Agent, or Firm*—John P. McGonagle

[57] ABSTRACT

A device which wets in a sanitizing solution and dispenses disposable paper towels. A continuous roll of dry paper towels is inserted into a canister within a larger container. The canister has an opening through which towels exit the canister into the interior of the larger container. External to the canister, but internal to the larger container, are broad, flat belts which engage the towels as they exit the canister and carry the towels through a sanitizing solution to an opening in the larger container. The belts are geared to and driven by a lever external to the larger container. When the lever is pulled, a sanitizing towel is dispensed from the larger container.

10 Claims, 4 Drawing Figures

FIG 3
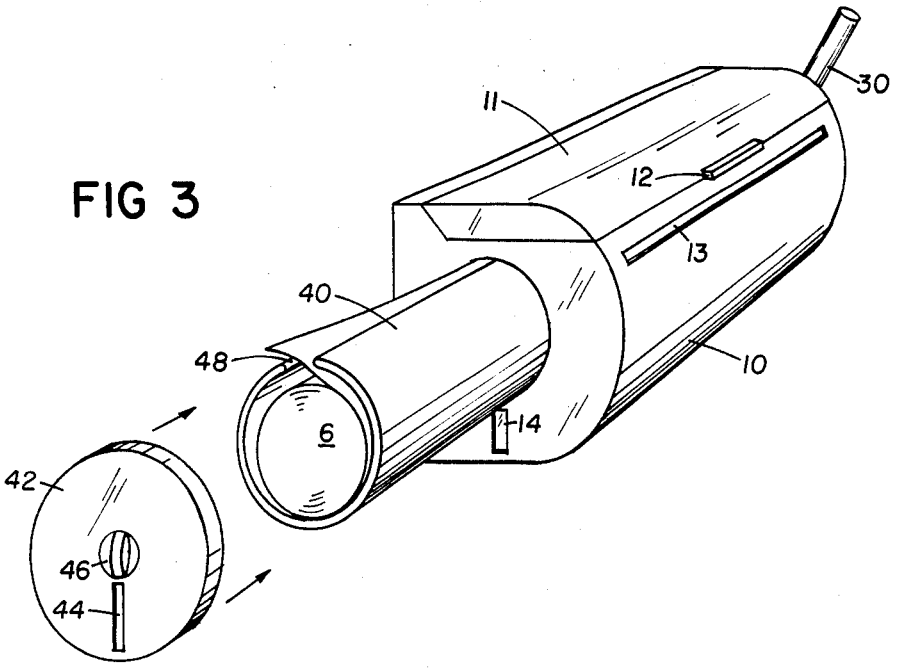
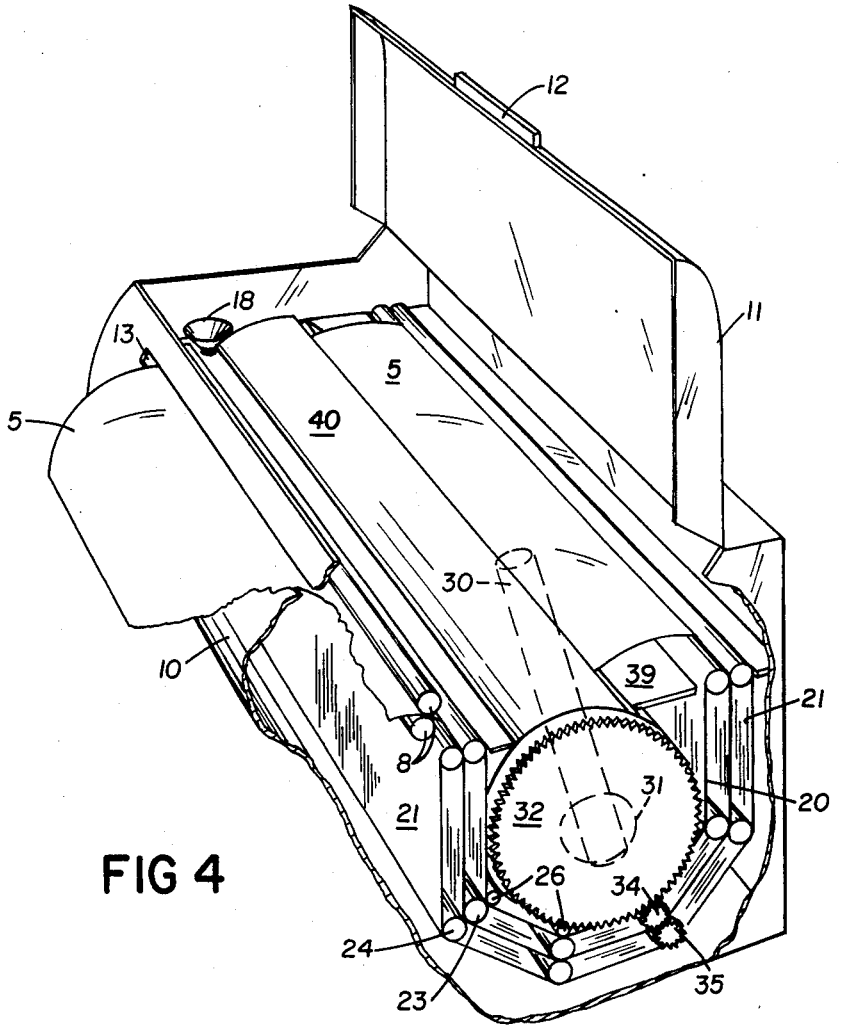
FIG 4

HAND SANITIZER

BACKGROUND OF THE INVENTION

This invention relates to dispensing devices and more particularly to devices for dispensing moistened towels.

In a number of environments such as cafeteria and restaurant kitchens, hair dressing and barber shops, medical clinics and vetinary clinics, it is important that staff members sanitize their hands between tasks, clients, and/or patients. In such situations the need is to not only sanitize one's hands, but to do so quickly and easily.

This need is met by the present invention which wets in a sanitary solution and dispenses disposable paper towels. A continuous roll of dry paper towels is inserted into a canister within a larger container. The canister has an opening through which the towels exit the canister into the interior of the larger container. External to the canister, but internal to the larger container, are broad flat belts which engage the towels as they exit the canister and carry the towels through a sanitizing solution to an opening in the larger container. The towels then exit the larger container ready for use.

The belts are driven by a lever external to the container, which when pulled cause the belts to dispense from the container a sanitizing towel. Thus paper towels wetted with a sanitizing solution are quickly and easily made available.

Dispensing by means of the belts allow the paper towels to remain dry until actually needed. The belts also provide support for the towels as they are being wetted in the sanitizing solution and dispensed. Keeping the towels dry until needed substantially increases the towel shelf life. The belt arrangement and support in this invention permits ordinary off the shelf paper towel rolls to be used without the tearing and disintegration problems of previous inventions.

Other objects and features of the present invention will become apparent from the following detailed description considered in connection with the accompanying drawings which disclose a preferred embodiment of the invention.

BRIEF DESCRIPTION OF THE DRAWINGS

FIG. 3 is a partially exploded view of FIG. 1 with canister cover removed, and canister partially removed from the larger container.

FIG. 4 is a perspective view showing the front and side opposite that shown in FIG. 1, with container and lever partially removed to show the invention's interior.

DETAILED DESCRIPTION OF THE INVENTION

Figure 1:
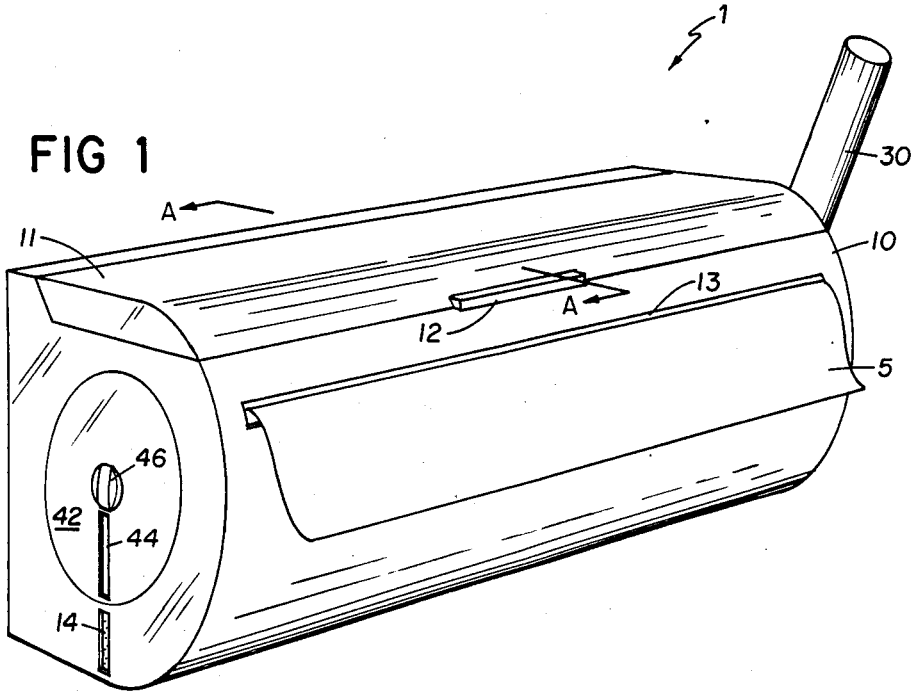
FIG. 1 is a perspective view showing the front and one side of the invention.
Figure 2:
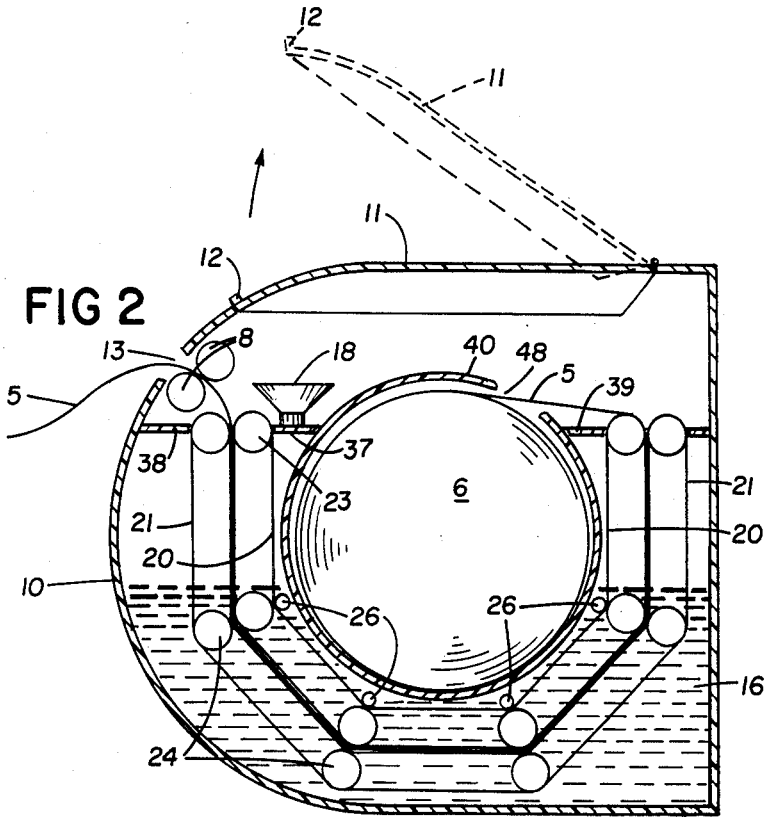
FIG. 2 is a cross-sectional view taken on line A—A of FIG. 1.

In describing the invention in detail, reference will be had to the accompanying drawings wherein like characters denote like or corresponding parts throughout the several views. Referring more particularly to the drawings, reference numeral 1 refers generally to the towel dispenser comprising one embodiment of the present invention.

The invention 1 is enclosed within a container 10 having a top lid 11 with a handle 12 for opening and closing the top lid 10. The paper towels 5 emerge from the container 10 through a horizontal slit 13 across the front of the container 10 below the top lid 11. The dispenser 1 is mechanically activated by a lever 30 on one side of the container 10, which when pulled in a downward motion causes the dispenser 1 to send forth a towel 5. The towel 5 is then removed by simply tearing it off across the horizontal slit 13.

A key premise of the present invention is that standard, off the shelf rolls of paper towels may be used in the invention. To that end a continuous roll 6 of paper towel 5 is accomodated in a canister 40 which is axially positioned horizontally within the container 10. In this embodiment, the canister has a cylindrical shape. FIG. 3 best shows this. The canister 40 is removable from the container 10. The canister 40 has a longitudinal slit 48 along its length. The canister 40 has a removable end cap 42. To load a paper towel roll 6, the canister 40 is removed from the container 10. To assist in this operation, the end cap 42 has a handle 46 for pulling the canister 40 out of the container 10. The end cap 42 is then removed from the canister 40 and a roll 6 of paper towels inserted. The end cap 42 is then replaced on the canister 40 and the canister 40 inserted into the container 10. The end cap 42 has a linear transparent section 44 radiating from its center. This permits external observation, without removing the end cap 42, of the quantity of towels 5 still remaining on the roll 6.

When the canister 40 is inserted into the container 10, the top lid 11 is lifted upward and the canister 40 is rotated so that its longitudinal slit 48 faces the rear of the top lid 11. A first towel 5 is manually drawn through the longitudinal slit 48 and positioned to engage a path between an inside belt 20 and an outside belt 21. The belts 20 and 21 extend horizontally nearly the width of the container 10. The inside belt 20 is looped in an inside path about the canister by six horizontal roller bars 23. The outside belt 21 is looped also about another six roller bars 24 in an outside path about the canister 40. The inside belt 20 is further positioned about the canister 40 by four interior guide bars 26 which extend horizontally along the longitudinal axis of the canister 40. The towels 5 travel from the canister's longitudinal slit 48, rearward across a horizontal guide 39 which is positioned just below the longitudinal slit 48, down between the two belts 20 and 21, below and around to the front of the canister 40, up between two positioning guides 8 placed horizontally inside the container 10 at the container's horizontal slit 13, and out of the container 10 through the horizontal slit 13.

The towels 5 are drawn by the belts 20 and 21, which are in turn driven by a conventional lever 30, main drive gear 32, and belt driving gears 34 and 35. A conventional ratchet mechanism 31 would be appropriate between the lever 30 and main drive gear 32.

The canister 40 and container 10 are configured so that a liquid 16 may be held within the container 10 to depth of approximately one-half of the radial thickness of the canister 40. The canister 40, except for its longitudinal slit 48, is water tight. When the canister 40 is inserted into the container 10, the canister end cap 42 is flush against the side of the container 10 forming a water tight seal for the container 10. The liquid 16 would be a hand sanitizing solution poured into the container 10 through a receptacle 18 near the top front of the container 10 underneath the lid 11. The belts 20 and 21 would be made of a permeable material so that the towels 5 would be wetted with the sanitizing solution as they pass from the canister opening 48 to the container opening 13. To control splashing as the lever 30 is pulled, horizontal members 37 and 38, as well as the guide member 39, are so positioned that the liquid 16 and splashes are contained below them. To determine if the level of liquid 16 within the container 10 is too low, the side of the container 10 into which the canister 40 is inserted contains a vertical, linear, transparent section 14 below the opening into which the canister 40 is inserted. With one glance the sanitizing solution 16 and the towel roll 6 may be checked through the transparent sections 14 and 44.

It is understood that the above-described embodiment is merely illustrative of the application. Other embodiments may be readily devised by those skilled in the art which embody the principles of the invention and fall within the spirit and scope thereof.

I claim:

1. A device for wetting and dispensing towels, comprising:

a wall-mountable container having a front and back, top and bottom, and two sides, wherein the top is substantially a lid pivotally connected toward the back of the top and opening about said connection in an upward and backward direction, and wherein the front contains a horizontal slit across the front of the container below the front of the top lid;

a generally cylindrical canister for holding a roll of towels within, which canister is positioned along its longitudinal axis horizontally within the container, parallel to the container front, and having a longitudinal opening along its length, facing the rear of the top lid of the container;

a plurality of roller bars each of which having a length approximately equal to the length of the canister, horizontally positioned within the container about and parallel to the longitudinal axis of the canister;

a plurality of parallel belts, looped about the roller bars, having a width nearly equal to the length of the canister and forming a towel path about the radial circumference of the canister running substantially from the longitudinal opening in the canister downward along the inside back of the container, forward across the inside bottom of the container, and upward along the inside front of the container to a point just below the horizontal slit across the front of the container; and means for advancing a towel from the canister, along the towel path and out of the container through its horizontal slit.

2. A device in accordance with claim 1 wherein:

the container and canister are so configured that a liquid may be held within the container to a depth of approximately one-half of the radial thickness of the canister.

3. A device in accordance with claim 2 wherein:

the canister is removable from the container through an aperature in one side of the container.

4. A device in accordance with claim 3 wherein:

the canister has a removable end cap so located and configured that when the canister is inserted into the container, the canister end cap is flush against and fitted within the container side aperature forming a water tight seal for the container.

5. A device in accordance with claim 4 wherein:

the canister end cap has a handle for pulling the canister out of the container.

6. A device in accordance with claim 5 wherein:

the canister end cap has a linear, transparent section radiating from its center downward.

7. A device in accordance with claim 6 wherein:

the container has a receptacle near its top front for introduction of liquid into the container.

8. A device in accordance with claim 7 wherein:

the side of the container into which the canister is inserted contains a vertical, linear, transparent section below the aperature into which the canister is inserted.

9. A device in accordance with claim 8 wherein:

the belts are made of a permeable material so that the towels will be wetted with the liquid as they pass from the canister longitudinal opening to the container horizontal slit.

10. A device in accordance with claim 9 wherein the means for advancing a towel from the canister, along the towel path, and out of the container through its horizontal slit comprises:

a lever external to the container on the container side opposite to the side with the canister aperature;

a plurality of belt driving gears connected to the roller bars;

a main drive gear engaging the belt driving gears; and a ratchet mechanism interconnecting and engaging the lever with the main drive gear.

* * * * *